US005626632A

United States Patent [19]

Boyes

[11] Patent Number: 5,626,632

[45] Date of Patent: May 6, 1997

[54] PROCESS FOR DYEING CATIONIC DYEABLE POLYAMIDE FIBER

[75] Inventor: Geoffrey Boyes, Roanoke, Va.

[73] Assignee: Ronile, Inc., Rocky Mount, Va.

[21] Appl. No.: 470,697

[22] Filed: Jun. 6, 1995

[51] Int. Cl.[6] ..... D06P 1/39; D06P 3/06

[52] U.S. Cl. ..... 8/483; 8/539; 8/673; 8/680; 8/685; 8/924; 8/929

[58] Field of Search ..... 8/483, 673, 539, 8/676, 680, 681, 685, 924, 929; 428/375, 97, 364

[56] References Cited

U.S. PATENT DOCUMENTS

| | | |
|---|---|---|
| 3,995,993 | 12/1976 | Schlafer et al. . |
| 3,998,586 | 12/1976 | Schlafer et al. . |
| 5,085,667 | 2/1992 | Jenkins . |
| 5,131,918 | 7/1992 | Kelley . |
| 5,155,178 | 10/1992 | Windley . |
| 5,164,261 | 11/1992 | Windley . |
| 5,190,565 | 3/1993 | Berenbaum et al. . |
| 5,199,958 | 4/1993 | Jenkins et al. . |
| 5,242,733 | 9/1993 | Windley . |
| 5,342,417 | 8/1994 | Pacifici et al. . |
| 5,354,342 | 10/1994 | Jenkins . |
| 5,445,653 | 8/1995 | Hixson et al. ..... 8/531 |
| 5,466,527 | 11/1995 | Jenkins ..... 428/375 |

FOREIGN PATENT DOCUMENTS

| | | |
|---|---|---|
| 1223908 | 9/1989 | Japan . |
| 1260061 | 10/1989 | Japan . |

*Primary Examiner*—Margaret Einsmann
*Attorney, Agent, or Firm*—Rothwell, Figg, Ernst & Kurz

[57] ABSTRACT

A continuous dyeing, space dyeing or printing process for dyeing cationic dyeable polyamide fibers comprising the steps of applying a premetalized acid or acid dye to the fiber at a pH of 2.5 and below, and the dyed polyamide fiber resulting therefrom. The dyeing process generates cationic dyeable polyamide fiber dyed or printed in light to deep shades without bleeding and without producing badly contaminated dye water effluent.

11 Claims, No Drawings

PROCESS FOR DYEING CATIONIC DYEABLE POLYAMIDE FIBER

BACKGROUND OF THE INVENTION

1. Field of the Invention

The present invention relates to the field of dyeing cationic polyamide fiber, and the dyed cationic polyamide fiber resulting therefrom.

2. Prior Art

Dyeing techniques for the dyeing of cationic dyeable polyamide fiber, such as cationic nylon carpet fibers, with acid or premetalized acid dyes are well-known in the art. Known dyeing techniques include traditional batch dyeing (also referred to as beck or winch dyeing) wherein a complete textile substrate is dyed to a uniform color by placing a finite amount of the substrate into a dyeing machine for a given length of time, and running the substrate through a batchwise cycle during which time the substrate is usually immersed in an aqueous bath which contains the dyes and other necessary chemicals. The bath is heated for a length of time sufficient to exhaust the dye onto the substrate. Thereafter, the dye bath is drained, and the dyed substrate rinsed and then removed from the dye bath to a dryer.

Another known dyeing technique is space dyeing. Space dyeing is the dyeing of multiple colors along a single length of yarn. The dye colors selected for use in space dyeing are usually intense, saturated colors (deep shades), selected for their desired visual effect. The resulting space dyed fibers are especially popular in carpet manufacture.

Similarly, a dyeing technique referred to as printing is known for selectively placing one or more colors of dye on or in a textile substrate in a predetermined pattern. Printing may be accomplished using, for example, the following printing machines which are well known in the art: Tak, Foamcolor, Polychromatic (flow printers); Zimmer & Mitter (screen printer); Millitron, Titan, Chromatronic (jet printers).

Additionally, techniques are known for continuous dyeing of a textile substrate. Rather than placing the substrate in a dye bath, as is done in the batch dyeing technique, the dye is applied to the material by, for example, feeding the substrate in one end of a machine and applying the dye liquor. The substrate continues into a fixation chamber, usually a steamer, where it passes through steam for a sufficient amount of time to allow the dye to fix onto the substrate. Thereafter, any loose dye and chemicals are rinsed from the substrate and the substrate is dried.

Two important factors relative to the particular dyeing technique utilized are strike rate and exhaustion. The term "strike rate" refers to length of time necessary to fix the dye to the substrate being dyed. The term "exhaustion" refers to how completely a dye fixes to the substrate being dyed.

When the batch dyeing technique is used, the strike rate must be slow enough to result in a controlled, even dyeing of the substrate. If the strike rate is too fast, uneven dyeing of the substrate can result. After a slow, even strike has been achieved, if necessary, the dye can be exhausted by, for example, lowering the pH of the dye solution. See U.S. Pat. No. 5,164,261 issued to Windley on Nov. 17, 1992.

In contrast, when space dyeing or printing techniques are used to dye a substrate, the strike rate must be fast, i.e. 30–90 seconds, and dye exhaustion complete. If a fast strike rate is not achieved, the different colored dye liquors which adjoin at the color change interfaces will come in contact with one another and smear. Additionally, unacceptable color transfer can occur if the dyed substrate is plaited during fixation (such as steaming). If exhaustion is poor, the dyed substrate demonstrates low color yield and a large amount of unfixed dye remains in the waste water which must then be treated before disposal of the waste water.

U.S. Pat. No. 5,085,667 issued to Jenkins discloses a procedure for dyeing cationic dyeable nylon with acid or premetalized acid dyes using exhaust/batch dyeing and continuous dyeing techniques, at a pH of from about 4.0 to 6.5. Jenkins discloses a wide variety of acid and premetalized acid dyes as being suitable for dyeing cationic dyeable nylon at a pH of from about 4.0 to 6.5. However, at the pH range of 4.0 to 6.5 disclosed by Jenkins the strike rate is slow. Additionally, many of the acid and premetalized acid dyes listed by Jenkins, such as Nylosan Blue FGBLN (CI No. Acid Blue 127), Intrachrome Black WA (CI No. Acid Black 52) and Telon Black LDN (CI No. Acid Black 172) show poor exhaustion characteristics in medium to full depth shades at the disclosed pH range of 4.0 to 6.5. Consequently, at the pH range of 4.0 to 6.5, an unacceptable amount of unfixed dye remains in the waste water, resulting in the availability of only a light to medium depth of shade and the need to treat the waste water prior to disposal.

Japanese Pat. Application Publication Nos. 1-223908 and 260,061 recognized these problems, teaching that cationic dyeable polyamide fiber dyed with premetalized acid 1:2 acid dyes, at a pH of 7–8, exhibits high dye fastness, while milling acid dyes have weak bonding strength, give low fastness, low dye deposit (exhaustion) and low color intensity. As a result of slow strike rate, bleeding of the dyes occurs and color selection is limited.

Thus, a need exists in the art for a cationic polyamide fiber continuous dyeing, space dyeing or printing process which exhibits improved dye exhaustion and a faster strike rate, which allows for the use of a full spectrum of dye colors, and which results in intense, saturated colors (deep shades).

It has now been found that strike rate and dye exhaustion can be dramatically improved, especially in the medium to dark dye shades, when cationic dyeable polyamide fiber is continuous dyed, space dyed or printed with acid or premetalized acid dyes at a pH of 2.5 and below. At this pH, given the dramatically improved strike rate and exhaustion, a full spectrum of dye colors can be applied to the fiber, with highly contrasting and high intensity color depth, with little or no coloring of the waste water. Moreover, when space dyeing or printing techniques are used, little or no cross staining of the adjoining colored fiber occurs.

SUMMARY OF THE INVENTION

Briefly stated, the present invention is a continuous dyeing, space dyeing or printing process for dyeing a cationic dyeable polyamide fiber at a pH of 2.5 and below with acid and premetalized acid dyes resulting in a fast strike rate and complete exhaustion. The present invention allows for the use of a full spectrum of dye colors, resulting in highly contrasting and high intensity color depth, and little or no coloring of the rinse water, and little or no cross staining of adjoining color fiber.

Additionally, the present invention is a cationic dyeable polyamide fiber, preferably a nylon yarn or nylon carpet, composed of cationic dyeable polyamide fiber dyed by a continuous dyeing, space dyeing or printing technique with acid or premetalized acid dye at a pH of from 2.5 and below.

DETAILED DESCRIPTION OF THE INVENTION

As a first step in the method of the present invention, cationic dyeable polyamide fibers are provided for dyeing. The cationic dyeable polyamide fibers useful in the present invention include commercially available forms of cationic dyeable nylon. Exemplary of such cationic dyeable nylon is commercially available nylon 6 or nylon 6,6 containing cationic dye modifiers, solution dyed cationic nylon, etc.

The cationic dyeable polyamide fiber is dyed by applying premetalized acid or acid dyes to the fiber. Premetalized acid and acid dyes suitable for use in the present invention include commercially available premetalized acid or acid dyes. Preferably, the premetalized acid and acid dyes which may be used in the present invention include, but are not limited to, Nylosan Blue BRL (CI No. Acid Blue 324), Intrachrome Black WA (CI No. Acid Black 52), Telon Red 2BN, Telon Black LDN (CI No. Acid Black 172), Nylosan Blue FGBLN (CI No. Acid Blue 127), Nylanthrene Orange 3G (CI No. Acid Orange 156), Lanaset Blue 5G (CI No. Acid Blue 239), Neutral Cyanine Green GN (CI No. Acid Green 26), Erionyl Yellow 3GS, Isolan Navy Blue S-RL (CI No. Acid Blue 335), Intralan Black S-2B (CI No. Acid Black 224), Irgalan Navy BKWL (CI No. Acid Blue 229), Irgalan Grey BL (CI No. Acid Black 58), Irgalan Yellow 2GL (CI No. Acid Yellow 129), Intralan Yellow NW (CI No. Acid Yellow 151), Irgalan Yellow 3RL (CI No. Acid Orange 162), and Intralan Bordeaux 3RS (CI No. Acid Red 182).

The premetalized acid or acid-dye is applied to the cationic dyeable polyamide fiber at a pH of 2.5 and below. Preferably, the pH is 1.6–2.0, and most preferably is 1.8. The pH of the dye liquor is adjusted to a pH of 2.5 or below using, for example, phosphoric acid, sulfuric acid or Autoacid A-10 from Peachstate Labs.

The dye can be applied to the cationic dyeable polyamide fiber by the space dyeing, continuous dyeing or printing techniques discussed above. Preferably, the fiber is in the form of a yarn which is dyed using the space dyeing technique. That is, the dye composition is applied intermittently along the length of the yarn to create a desired effect. Another preferred method for applying the dye to the fiber, or to a nylon carpet, is to print on the fiber or carpet.

The dye is applied to the polyamide fiber at an ambient temperature. Dye fixation can be accomplished by methods generally known to those of skill in the polyamide fiber dyeing art, including, steaming, microwaving, ultrasound or radio frequency. Dye fixation time is preferably be between 2–10 minutes, most preferably 6 minutes.

The following examples are provided by way of illustration and explanation and as such are not to be viewed as limiting the scope of the present invention.

EXAMPLE 1

Production of a Contrasting Deep Colored "Long Space" Yarn on Cationic Nylon.

1. Packages of the cationic yarn (a DuPont Type 494 1245 denier in a plied, non heat set form) were arranged in a creel and fed into the dyeing line.
2. A set of squeeze rolls drew the yarn from the creel into a warp of yarns.
3. A second set of squeeze rolls pulled the yarn through a presteamer containing moist steam at 180 degrees F.
4. A final set of squeeze rolls provided the infeed point to the printing rollers.

5. The printing rollers consisted of stainless steel rollers, rotating in a pan of dye liquor (a dye station). The dye liquor was picked up by the rolls and formed a film on the surface of the rolls, upon which the yarn was depressed. The dye liquor contained the following formulations:

| Chemical Formulation For Each Dye Station: | |
|---|---|
| 4.5 g/l | DOSS (Amwet DOSS, American Emulsions) |
| 6.0 g/l | AUTOACID A-10 (Peachstate Labs Georgia) |
| 0.5 g/l | S.T.P. (Sodium Thiosulfate, Chlorine remover from Chemsolv) |
| pH 1.9 | |

| Dye Formulations: | |
|---|---|
| Print 1 | |
| Intralan Yellow NW 250% | 0.122 g/l |
| Intralan Bordeaux 3RS | 0.05 g/l |
| Irgalan Grey BL 200% | 0.720 g/l |
| Print 2 | |
| Intralan Yellow NW 250% | 3.36 g/l |
| Intralan Red 2G | 2.52 g/l |
| Irgalan Grey BL 200% | 0.672 g/l |
| Print 3 | |
| Irgalan Yellow 3RL | 8.53 g/l |
| Intralan Bordeaux 3RS | 0.45 g/l |
| Irgalan Grey BL 200% | 2.36 g/l |
| Print 4 | |
| Intralan Yellow NW 250 | 0.431 g/l |
| Intralan Bordeaux 3RS | 0.327 g/l |
| Irgalan Grey BL 200% | 4.014 g/l |
| Print 5 | |
| Intralan Yellow NW 250 | 2.77 g/l |
| Intralan Red 2G | 6.45 g/l |
| Irgalan Grey BL 200% | 0.159 g/l |
| Print 6 | |
| Intralan Yellow 250% | 0.69 g/l |
| Intralan Bordeaux 3RS | 3.87 g/l |
| Irgalan Grey BL 200% | 2.57 g/l |

(Intralan Dyes are manufacture by Crompton and Knowles corporation; Irgalan dyes are manufacture by Ciba Geigy Corp.)

6. The yarn was depressed by a steel presser plate, which was moved by an air cylinder in response to a signal from a computer to produce a pattern of colors onto the yarn warp.
7. The yarn proceeded into a steam chest at 210 degrees F. The yarn warp followed a horizontal path for approximately 60 seconds.
8. The yarn proceeded around a combination of horizontally opposed "star rolls" designed to make minimum contact with the yarn, while applying tension enough to transport it along the steamer.
9. The yarn web was then plaited onto a stainless steel mesh belt, where it was transported down the length of the steamer.
10. The yarn was withdrawn from the chest, and squeezed to begin the rinsing process.
11. The yarn was then dipped in a trough containing a commercially available dye fixative (10 g/l Simcofix N201A from Simco Chemicals).
12. The yarn was then steamed over vertically opposed rollers in a steamer at 210 degrees F for one to two minutes to fix the dye fixative.
13. The yarn was rinsed in cold water and squeezed once more before going into the dryer.
14. A belt dryer carried the yarn through forced air at 300 degrees until dry.

15. The yarn was withdrawn from the belt by a set of squeeze rollers.
16. Lubricant (50% solution of Presslube SSK, Presscott Chemical co.) was applied via kiss rolls.
17. The yarn next entered a J-Bin from which it is fed to winder stations where it is wound onto packages.

EXAMPLE 2

Production of a Full Black Print Section Interspersed with Short Segments of Brilliant Colors The dyeing system was identical to that in Example 1, but the dye formulas were modified as follows.

| Chemical Formulation For Each Dye Station: | |
|---|---|
| Prints 1 through 5 | |
| 4.5 g/l Doss | |
| 6.0 g/l Autoacid A-10 | |
| 1.0 g/l Gum (Progacyl RPa, Rhone Poulenc) | |
| pH 1.9 | |
| Print 6 | |
| 4.5 g/l Doss | |
| 6.0 g/l Autoacid A-10 | |
| 2.0 g/l Sulfuric acid | |
| 1.0 g/l Gum (Progacyl RPa, Rhone Poulenc) | |
| pH 1.6 | |
| Dye Formulations: | |
| Print 1 | 10 g/l |
| Intralan Red 2G | |
| Print 2 | 10 g/l |
| Irgalan Yellow 3RL | |
| Print 3 | |
| Intralan Bordeaux 3RS | 3.0 g/l |
| Nylosan Blue FGBLN | 2.0 g/l |
| Print 4 | |
| Intralan Red 2G | 0.2 g/l |
| Nylosan Blue FGBLN | 6.0 g/l |
| Print 5 | |
| Lanaset Blue 5G | 4.0 g/l |
| Erio Yellow 3GS | 1.0 g/l |
| Print 6 | 20 g/l |
| Intralan Black S-2B | |

EXAMPLE 3

Production of a Short Space Dyed Yarn with Full Black Print Section

1. The cationic yarn was first knitted into a 3 inch wide sock on an LR knitting machine with 45 needles.
2. Twelve socks were simultaneously fed into a J bin.
3. The sock was pulled from the J bin into a padder with horizontally opposed rollers (Peter Pad).

The peter pad contained a dye paste in the Nip which was applied to the socks at a pickup of 50–180%.

Formulation of the nip or Pad color was as follows:

Chemicals
- 1.0 g/l XP116 (non ionic wetter) (American Emulsions)
- 3.0 g/l Gum (polypro)
- 4.0 g/l Phycon ARL (American Emulsions)
- pH 2.2

Dyestuffs
- 4.0 g/l Lanacron Blue 5G
- 0.5 g/l Erio Yellow 3GS

4. The sock was transported over rollers beneath a row of print stations.

The print stations consisted of an embossed rubber roll which was partly immersed in a pan of high viscosity dye paste. The paste contained the following print formulations:

Chemicals
- 5.0 g/l gum (Polypro)
- 7.0 g/l Antifoam H, (American Emulsions)
- 5.0 g/l Phycon ARL (Acid Mix, American Emulsions)
- 1.0 g/l Amquest ADP-1 (American Emulsions)

Dyes

Print 1 and 4
- 5.0 g/l Nylosan Blue FGBLN 360%
- pH 2.0

Print 2 and 5
- 7.0 g/l Nylanthrene Blue GLF
- 2.0 g/l Erio Yellow 3GS
- pH 2.0

Print 3 and 6
- 15 g/l Intralan Black S-2B
- pH 1.8

5. The sock continued to pass over the embossed print roll and were forced to contact the roll surface by pressure from a back roller, above the print roll. The print roll, having an embossed pattern, transferred that pattern to the surface of the sock, where it made contact.
6. The sock continued to pass through print stations 2 and 3, and was then reversed, and continued in its original direction through print rollers 4, 5 and 6.
7. The sock next entered the steamer at 210 degrees where it was plaited on a stainless steel belt, after spending 15 seconds, in the throat feed section of the steamer.
8. The sock spent 6–10 minutes in the steamer during which time the dye was fixed.
9. The sock emerged from the steamer and was rinsed in hot water and squeezed to remove gum and other dyeing impurities which would affect the handling properties of the subsequent yarn.
10. A finish was applied to the yarn.
11. The sock entered a dryer where it was dried at 350 degrees.
12. The sock was fed into an individual can, from which the product was deknitted back onto packages.

EXAMPLE 4

Dye exhaustion was evaluated using the following method.

The substrate was a cationic yarn, which was knitted into a circular knit sock about 2.5 to 3 inches wide.

The dyestuff formula to be evaluated was mixed with the necessary dyes and chemicals (See Example 1 for formulation) to the amount of one liter at both a pH of 4.0 and 1.8. The sock was cut to a length of 6 inches and weighed. The weight was multiplied by the percent pickup to calculate the amount of dye solution to be applied. Normally, this pickup varies from 120 to 300%.

The correct amount of dye liquor was measured into a shallow tray, 2.5 inches by 6 inches, and one inch deep. The volume was then increased to a 300% total pickup by adding additional "blank" liquor. The "blank" liquor comprised the chemicals used in the dye mix, without any dye. The purpose of increasing the total pickup to 300%, in cases where the yarn would normally pick up less, was to provide enough liquid to saturate the yarn in the shallow pan.

Once the total amount of liquid was in the pan, the sock was added and then pressed by a simple plastic plate, to evenly squeeze the liquid throughout the sock.

The sock was then placed on a frame containing rows of support pins 5 inches apart. This allowed the center portion of the sock to be supported without contact with any metal etc.

The frame was inserted into a tray type steamer, at 210 deg F., for 6 minutes.

The frame and sample were removed, and the sample rinsed with cold water. All the rinse liquid was captured and placed in an Ahiba dye tube.

Water was added to the rinse liquid to provide a 30:1 liquor ratio for the subsequent dyeing.

An equal weight of regular nylon sock was placed in the Ahiba sample support, and the rinse liquor was totally exhausted onto the nylon.

The percent dye fixation on the cationic nylon dyed sample dyed at both a pH of 4.0 and 1.8 and the percent dye fixation on the exhaust dyed regular nylon were measured on a spectrophotometer. The results are summarized in Table 1.

TABLE 1

| Dyestuff Name (5 g/l Dyestuff Concentration) | Dyeing | Rinse | Dyeing | Rinse | Dyeing | Rinse |
|---|---|---|---|---|---|---|
| | pH 4.0 | | pH 1.8 | | Increase | Decrease |
| Nylosan Blue BRL (Acid Blue 324) | 37% | 63% | 87% | 13% | 131% | 364% |
| Intrachrome Black WA (Acid Black 52) | 41% | 59% | 90% | 10% | 118% | 481% |
| Telon Red 2BN | 42% | 58% | 86% | 14% | 103% | 312% |
| Telon Black LDN (Acid Black 172) | 49% | 51% | 98% | 2% | 100% | 2389% |
| Nylosan Blue FGBLN (Acid Blue 127) | 63% | 37% | 98% | 2% | 56% | 1532% |
| Nylanthrene Orange 3G (Acid Orange 156) | 44% | 56% | 68% | 32% | 52% | 72% |
| Lanaset Blue 5G (Acid Blue 239) | 64% | 36% | 94% | 6% | 46% | 463% |
| Neutral Cyanine Green GN (Acid Green 26) | 59% | 41% | 81% | 19% | 36% | 113% |
| Erionyl Yellow 3GS | 71% | 29% | 94% | 6% | 32% | 398% |
| Isolan navy Blue S-RL (Acid Blue 335) | 85% | 15% | 99% | 1% | 17% | 1053% |
| Intralan Black S-2B (Acid Black 224) | 86% | 14% | 98% | 3% | 14% | 569% |
| Irgalan Navy BKWL (Acid Blue 229) | 87% | 13% | 97% | 3% | 12% | 378% |
| Irgalan Grey BL (Acid BLack 58) | 88% | 12% | 98% | 2% | 11% | 497% |
| Irgalan Yellow 2GL (Acid Yellow 129) | 90% | 10% | 96% | 4% | 7% | 179% |
| Intralan Yellow NW (Acid Yellow 151) | 93% | 7% | 99% | 1% | 6% | 653% |
| Irgalan Yellow 3RL (Acid Orange 162) | 93% | 7% | 98% | 2% | 4% | 170% |
| Intralan Bordeaux 3RS (Acid Red 182) | 98% | 2% | 99% | 1% | 1% | 144% |

Table 1 demonstrates the dramatic increase in dyestuff color yield and the dramatic decrease in rinse water color yield when the pH of the dye liquor is decreased from a pH of 4.0 to a pH of 1.8. At the pH of 1.8 a full spectrum of dye colors with highly contrasting and high intensity color depth are available. Additionally, little or no coloring of the rinse water resulted.

EXAMPLE 5

Strike Rate Test Procedure

The dye strike rate was evaluated using the same method used for evaluating exhaustion (See Example 4). The dye liquor contained 6 g/l Erionyl Yellow MR (Acid yellow 151), 4 g/l Intralan Bordeaux 3RS (acid red 182), 6 g/l Irgalan Grey BL (acid black 58), 7.0 g/l Doss and the amount of Autoacid A-10 necessary to adjust the pH of the dye liquor to a pH of 6.0, 5.0, 4.0, 3.0, 2.0 and 1.8. The sock was dyed at 300% wet pick up. The steaming step was performed for both one minute and six minutes.

The percentage of dye exhausted on the cationic nylon at each pH after one minute and six minutes, versus the percentage of dye in the rinse, demonstrated the relative strike rate at each pH and time interval. These measurements were determined visually and are summarized in Table 2.

TABLE 2

| pH | 6.0 | 5.0 | 4.0 | 3.0 | 2.0 | 1.8 |
|---|---|---|---|---|---|---|
| % dye exhaust one min | 20% | 20% | 20% | 25% | 40% | 90% |
| % dye exhaust six min | 80% | 80% | 80% | 80% | 90% | 98% |
| % dye in rinse one min | 80% | 80% | 80% | 75% | 60% | 10% |
| $ dye in rinse six min | 20% | 20% | 20% | 20% | 10% | 2% |

The results summarized in Table 2 demonstrate that the amount of dye fixed at a pH of 1.8 in only one minute is equal to or greater than the amount of dye fixed in six minutes at a pH of 3–6. Additionally, an increase in strike rate at both one minute and six minutes was observed when the pH was changed from 3.0 to 2.0.

What is claimed is:

1. A process for dyeing a cationic dyeable polyamide fiber by continuous dyeing, space dyeing wherein a length of the fiber is contacted at intermittent spaces along its length with a dye, or a printing process which comprises applying a premetalized acid or acid dye as defined by the Colour Index to the fiber at a pH of 2.5 or below.

2. The process of claim 1, wherein the dye is applied using a space dyeing or printing technique.

3. The process of claim 1, wherein the dye is applied at a pH of 1.6 to 2.0.

4. The process of claim 3, wherein the dye is applied at a pH of 1.8.

5. The process of claim 1, wherein the polyamide fiber is in the form of a yarn.

6. The process of claim 5, wherein the yarn is space dyed by contacting the yarn at intermittent spaces along its length with more than one dye color.

7. The process of claim 1, wherein the polyamide fiber is in the form of nylon carpet.

8. The process of claim 7, wherein the nylon carpet is printed by contacting the carpet in a predetermined pattern with more than one dye color.

9. A process for dyeing a cationic dyeable polyamide fiber by printing or space dyeing wherein a length of the fiber is contacted at intermittent spaces along its length with a dye which comprises applying a premetalized acid or acid dye as defined by the Colour Index to the fiber at a pH of 2.5 or below.

10. A process for dyeing nylon carpet fibers by a space dyeing technique wherein a length of fiber is contacted at intermittent spaces along its length with a dye which comprises applying a premetalized acid or acid dye as defined by the Colour Index to the nylon carpet fibers at a pH of 2.5 or below.

11. A process for printing nylon carpet comprising applying a premetalized acid or acid dye as defined by the Colour Index to the nylon carpet at a pH of 2.5 or below.

* * * * *